United States Patent [19]

Ekmark

[11] 4,320,648

[45] Mar. 23, 1982

[54] METHOD FOR MAKING ROOFING

[76] Inventor: Bo Ekmark, Fältspatstigen 60, 951 64 Lulea, Sweden

[21] Appl. No.: 219,831

[22] Filed: Dec. 24, 1980

Related U.S. Application Data

[63] Continuation of Ser. No. 955,217, Oct. 27, 1978, abandoned.

[30] Foreign Application Priority Data

Nov. 10, 1977 [SE] Sweden ..... 7712692

[51] Int. Cl.[3] ..... B21D 13/10

[52] U.S. Cl. ..... 72/301; 72/379; 428/603; 52/314; 52/555

[58] Field of Search ..... 52/314, 555, 557, 558, 52/535, 536, 537; 428/183, 603, 604; 72/295, 300, 301, 395, 350, 351, 415, 417, 465, 177, 379; 113/116 F, 116 Y

[56] References Cited

U.S. PATENT DOCUMENTS

| | | | |
|---|---|---|---|
| 1,226,564 | 5/1917 | Miller | 52/537 |
| 2,670,779 | 3/1954 | Mowrey | 72/301 |
| 2,901,951 | 9/1959 | Hochfeld | 428/603 |
| 3,000,423 | 9/1961 | Aris | 72/301 |
| 3,340,719 | 9/1967 | Kandle et al. | 72/397 |
| 4,250,728 | 2/1981 | King | 72/177 |

FOREIGN PATENT DOCUMENTS

| | | | |
|---|---|---|---|
| 2551505 | 5/1976 | Fed. Rep. of Germany | 52/555 |
| 580572 | 9/1946 | United Kingdom | 52/314 |

*Primary Examiner*—Lowell A. Larson

*Attorney, Agent, or Firm*—LeBlanc, Nolan, Shur & Nies

[57] ABSTRACT

A method, and an apparatus for carrying out that method, for making roofing from a stretchable and deformable sheet material. The roofing sections are made from sheet material which has a preformed laterally sinu-soidal configuration which is reconfigured with longitudinally spaced steps (or folds). The finished sheet is a roofing section having the configuration of stepped tile roofing which is a substitute for true roofing tile. The sinu-soidal sheet is clamped (or pressed) in a tool between two adjacent pairs of complimentary shape clamping jaws. In that tool apparatus the two pairs of clamps are then moved relative to each in parallel paths normal to longitudinal and lateral planes through the sheet, which movement stretches the sheet to form a step (or fold) between the portions held in the two sets of clamps. More than two sets of pairs of tools can be used to simultaneously form multiple steps and alternatively the sinu-soidal sheet can be periodically shifted and step stretched in a continuous operation.

2 Claims, 8 Drawing Figures

METHOD FOR MAKING ROOFING

CROSS-REFERENCE TO RELATED APPLICATION

This application is a continuation of application Ser. No. 955,217 filed Oct. 27, 1978 , now abandoned.

BACKGROUND OF THE INVENTION

Roofs at present are covered with many different materials, for example tiles and sheets. Tile roofs are attractive, and many private persons want the roofs of their own homes be covered with tiles. Tiles, however, are expensive. The field of manufacture of roof tiles is gradually ceasing to exist due to lack of profitability, which probably will result in a future shortage of roof tiles.

The tin roofs existing today consist of flat sheets or of conventionally roll-formed sheets of different appearance, or of trapezoid corrugated sheets, and the like.

The new invention is a kind of heet-tile roof, which means that the roofing consists of sheets, but has the appearance of tiles. The new sheet-tile roof is manufactured in large units and comprises a plurality of "tiles", so that several rows of "tiles" are obtained in both directions, vertically as well as in lateral direction. The large units then can be cut to desired sizes. The individual "tile" in the large unit, besides, can be manufactured in different sizes (modules) according to desire. This new roofing is cheaper to manufacture and cheaper to lay (mount) on the roof than a conventional tile roof. It has the look, besides, of a usual tile roof and, therefore, the new roofing also is attractive to many people.

The new roofing also is attractive compared with conventional roofing of sheet material, because the new roofing has the appearance of a tile roof.

The new roofing, besides, is advantageous from a productioneconomic view.

Further novel features and other objects of this invention will become apparent from the following detailed description, discussion and the appended claims taken in conjunction with the accompanying drawings.

BRIEF DESCRIPTION OF DRAWINGS

A representative sheet-tile and tools relating to this invention are disclosed in the accompanying drawings, in which.

Figure 4:
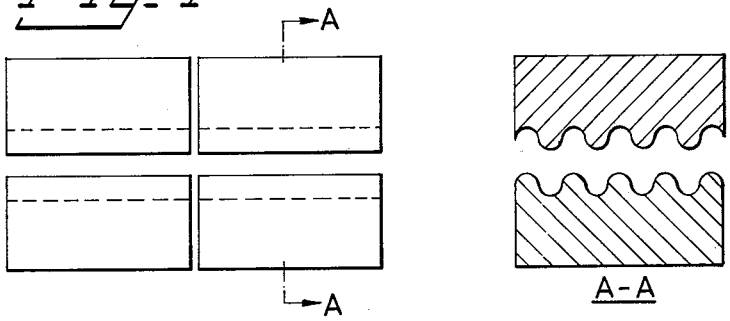
FIG. 4 is a side view of two pairs of tools or jaws.

FIG. A—A is a section taken through line A—A of FIG. 4

Figure 5:
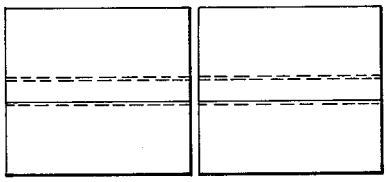
Figure 6:
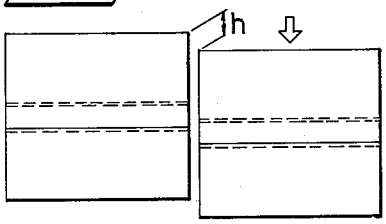
Figure 7:
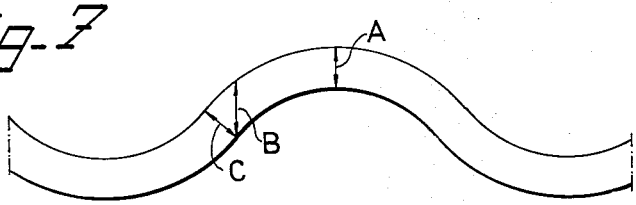
Figure 8:
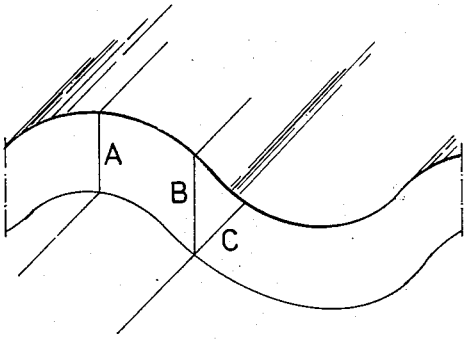

FIGS. 5 and 6, show the two pairs of jaws closed with FIG. 6 illustrating that the two pairs of closed jaws are relatively moved to form the step in a sheet of material (now shown);

FIGS. 7 and 8 show the portion of the sheet which is stepped or folded, illustrating different degrees of stretch at different locations along the curved sheet.

GENERAL DESCRIPTION

In the following, the roofing and a method and an apparatus for making the same are described.

Figure 2:
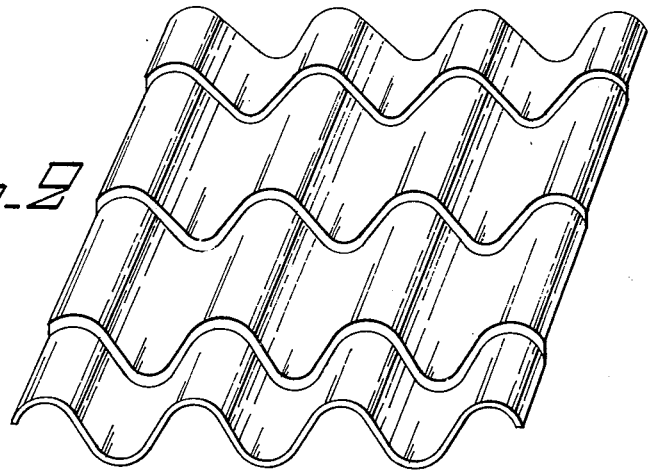
FIG. 2 illustrates the sheet of FIG. 1 with the steps formed therein to provide a tile-like appearance.

The appearance of the roofing is shown in FIG. 2, where the size of the individual "tiles" can be varied both in lateral and vertical direction. The number of tile rows, too, can be varied in both directions.

The method comprises the steps of roll-forming or pressing or bending sheets, which possibly are plastic-coated or surface-treated in some other way. The sheet is formed so that its sinuosity and the different radii of curvature agree with the corresponding appearance of the tile. In this way it is possible to vary the size and measures in lateral direction of the individual "tile" by manufacturing a formed sheet with corresponding sinuosity and radii of curvature.

Figure 1:
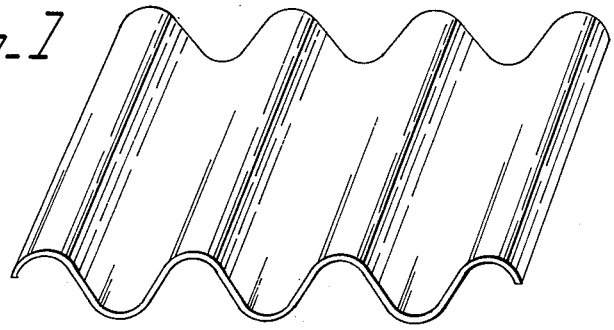
FIG. 1 illustrates a pre-formed sinu-soidal sheet of roofing material.

Of the formed sheet (an example is shown in FIG. 1) sheet-tiles are then manufactured by making a "jag" or fold in vertical direction (FIG. 2) by some kind of stretch-pressing, which brings about these folds transverse to the profiling direction at suitable centre distances which, of course, can vary depending on the feed lengths, as is explained below.

Figure 3:
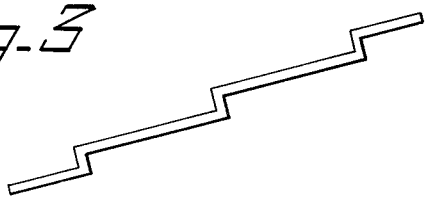
FIG. 3 is a longitudinal section or edge view of the stepped sheet.

FIG. 3 shows sheet-tiles seen from the side where also said folds are shown, which correspond to the overlapping in height between two usual roof tiles. The folds corresponding to the lateral overlapping between two usual roof tiles is obtained by the shape of the roll-formed sheet according to above.

The shaped section is formed to sheet-tiles by means of a tool (FIGS. 4–6), which consists of four separate parts according to FIG. 4, where the tool is shown with the different parts in separated state. The different parts have such a shape that they both fit into each other and agree with the shape of the roll-formed section (see section A—A in FIG. 4).

When the formed sheet has been positioned in the tool, the sheet first is secured by being pressed between the two parts to the left and between the two parts to the right of the tool. In this way the formed sheet blank is held firmly, clamped by each of the left and right parts of the tool which is necessary for continuing the operation.

Thereafter the fold or step formation is accomplished in that, for example, with both right and left hand tool halves maintaining their clamping forces on the sheet blank, the right-hand tool half is moved downward (see FIG. 6) through a distance h, i.e. one fold is formed at a time. The movement of the tool parts is effected by separate movements for the different tool parts, for example by springs or separate cylinders.

FIG. 7 shows the horizontal portion of the fold, i.e. that portion which corresponds to the vertical overlapping at two usual roof tiles. FIG. 8 is a perspective view of the same detail. When the fold is being formed, the sheet is stretched differently in the parts A and BC, which can result in uncontrolled fold formation.

In order to avoid such uncontrolled fold formation, the tool can be designed in different ways. The holding can be varied across the shape of the tool, i.e. the holding must not be equal in A and BC, but shall be greater in BC at an equal pressing-down of the tool. The tool may also be designed so that the height of the fold is different in A and BC, whereby an equal stretch of the sheet over the fold is obtained. A third alternative is to design the tool so, that an impression is made in the horizontal portion of the fold in the area at BC, which brings about equal stretch in the sheet.

It can also be imagined, of course, to make one or several folds simultaneously, in which latter case several tools in series are required.

I claim:

1. A method of making a roofing of sheet metal for outer roofs, characterized in that: a sheet is preformed so that it, in a first cross section perpendicular to the surface extension of the sheet, is given a section across the complete sheet which is curved to a configuration in the nature of a multiple wave, e.g., a sinus shape; the preformed sheet is then provided with stepped jags effectively constituting steps, where the height of the steps can be varied arbitrarily, by a stretch-pressing operation, wherein a pressing tool assembly is parted and at least consists of two pair of pressing and clamping tools; and where adjacent portions of the preformed sheet is first retained by each of the pair of tools in a clamping condition; with the clamping condition maintained, the two pairs of tools are thereafter then moved in an offset manner relative to each other in a direction normal to the sheet, a distance corresponding to the desired height of said steps so that the sheet in a second cross section, perpendicular to both the surface extension of the sheet and said first cross section, is given a formation of a step, whereafter the preformed sheet is advanced through a desired optional distance whereafter the step forming process is repeated to create additional steps.

2. A method according to claim 1 characterized in that several spaced-apart steps are formed simultaneously by a stretch-pressing operation using more than two pairs of tools, acting simultaneously.

* * * * *